United States Patent [19]

Hoffmann

[11] 4,270,033

[45] May 26, 1981

[54] BRAKE-FLUID LEVEL DETECTOR

[75] Inventor: Alfred Hoffmann, Bad Harzburg, Fed. Rep. of Germany

[73] Assignee: Helphos-Autolight Schardmüller & Co., Bad Harzburg, Fed. Rep. of Germany

[21] Appl. No.: 43,850

[22] Filed: May 30, 1979

[30] Foreign Application Priority Data

Jun. 1, 1978 [DE] Fed. Rep. of Germany ..... 2824035

[51] Int. Cl.[3] ..... H01H 35/18

[52] U.S. Cl. ..... 200/84 C; 73/313; 340/623

[58] Field of Search ..... 200/84 C, 61.2; 340/618, 620, 623, 624, 52 C; 73/308, 313, 317, 319

[56] References Cited

U.S. PATENT DOCUMENTS

| | | | |
|---|---|---|---|
| 3,051,805 | 8/1962 | Binford | 200/84 C |
| 3,934,103 | 1/1976 | Walstra | 200/84 C |

FOREIGN PATENT DOCUMENTS

| | | | |
|---|---|---|---|
| 1060944 | 4/1954 | France | 200/84 C |
| 639495 | 5/1962 | Italy | 200/84 C |
| 1115833 | 5/1968 | United Kingdom | 200/84 C |

*Primary Examiner*—Gerald P. Tolin
*Attorney, Agent, or Firm*—Montague & Ross

[57] ABSTRACT

A fluid-level detector comprises a container, here a brake-fluid reservoir for an automotive vehicle, adapted to hold a supply of a fluid and containing a float connected via a link arm to a permanent magnet for displacement of the magnet vertically through a predetermined magnet position on vertical displacement of the float through a predetermined float position corresponding to a fluid level at which a signal is to be given. A pair of contacts outside the container can be engaged by a switch element which is displaceable toggle-fashion by the magnet between a closed position engaging and forming a closed circuit with the contacts and an open position out of engagement with at least one of the contacts. A pair of abutments on the container defines a pair of stable end positions for the switch element which respectively correspond to the open and closed positions thereof and establishes an unstable metastable position between the stable positions which corresponds generally to the predetermined magnet position. Thus as the magnet passes through the predetermined magnet position the switch element moves between the open and closed positions.

12 Claims, 4 Drawing Figures

BRAKE-FLUID LEVEL DETECTOR

FIELD OF INVENTION

The present invention relates to a fluid-level detector. More particularly this invention concerns a detecting device usable in a brake-fluid reservoir to indicate when the brake fluid therein has dropped below a safe level.

BACKGROUND OF THE INVENTION

A level detector or sensing switch usable in a brake-fluid reservoir is described in U.S. Pat. No. 3,934,103. This arrangement has a float that is in the reservoir and that can pivot about a horizontal axis. A bar magnet extending perpendicularly across the axis has an end juxtaposed through a nonmagnetic wall of the reservoir with a ferromagnetic ball displaceable between a lower open-circuit position out of engagement with a pair of contacts and an upper closed-circuit position engaging a pair of contacts. As the liquid level inside the reservoir drops the magnet tips and slowly moves this ball upwardly until it engages the contacts in the upper position and closes a circuit indicating that the fluid in the reservoir has dropped below a safe level.

This system has shown itself in practice to have several disadvantages. Mainly when subjected to a severe jolt the ball can frequently be bounced upwardly into the closed-circuit position so that the arrangement gives a false warning. What is more when it is properly displaced into the upper position and held therein by the magnet, a severe jolt will allow it to drop downwardly into the open-circuit position. In this lower position the magnetic force is not sufficient to raise it back up, so that although the float is down, indicating that the fluid level is too low, no warning will be given. Finally it is noted that the ball itself only lightly and normally intermittently engages the contacts, so that at best the warning light will flicker.

OBJECTS OF THE INVENTION

It is therefore an object of the present invention to provide an improved detector.

Another object is to provide such a detector which can be used in a brake-fluid reservoir of an automotive vehicle.

Yet another object is to provide a detector which surely provides a warning whenever the fluid in the reservoir passes a predetermined level.

Finally an object of this invention is to provide such an arrangement where once the predetermined level has been passed, whether in the up or down direction, the circuit will be firmly closed or opened, without any intermittent opening or closing.

SUMMARY OF THE INVENTION

These objects are attained according to the instant invention in a fluid-level detector comprising a container adapted to hold a supply of a fluid and in which is provided a float connected via link means to a permanent magnet so that the permanent magnet moves vertically through a predetermined position on vertical displacement of the float through a predetermined float position corresponding to a fluid level at which a signal is to be given. A pair of contacts outside the container is engageable with a magnetically attractable switch element also outside the container which is displaceable by the magnet between a closed position engaging and forming a closed circuit with the contacts and an open position out of engagement with at least one of the contacts. Means is provided on this container including a pair of abutments for defining a pair of stable end positions for the switch element respectively corresponding to the open and closed positions thereof and for establishing an unstable metastable position between these stable positions which corresponds generally to the predetermined magnet position. Thus in accordance with the instant invention as the magnet is moved by the float through the predetermined magnet position the switch element moves between the open and closed positions. In effect the instant system creates a toggle linkage using the magnetic field as one link of the linkage, so that the switch element is either positively held by the magnet in the open position or in the closed position. When in the closed position it is positively urged by the magnet into contact with the two contacts and when in the open position it is positively held out of engagement with these contacts.

According to further features of this invention the switch element rocks about a horizontal axis defined by a blade formed on the wall of the container. This switch element has a pair of vertically spaced magnetically attractable, normally ferromagnetic, legs flanking the pivot. One of the legs is relatively close to the wall and the other relatively far from the wall in one of the end stable positions of the switch elements and vice versa.

The magnet itself is a bar magnet having a longitudinal magnet axis generally parallel to the rocking axis of the switch element and is magnetized transversely to the magnet axis. Thus the magnet can be held relatively loosely by the link means. In addition each of the legs is formed with a foot that is also ferromagnetic and that is elongated parallel to the magnet. Each foot has a face that lies flatly against the abutment formed by the wall of the container in one position, so that in the respective position the switch element is firmly held in place and does not move, even if the vehicle incorporating such an arrangement is subjected to a severe vertical jolt. Thus the element is generally U-shaped and has a bight portion interconnecting the legs and engaging the blade at the rocking axis. The faces of the feet lie at an angle smaller than 180° to each other so as flatly to engage the container walls in their respective positions.

According to another feature of this invention the switch element is received loosely with some play in the respective mounting structure, so that it will be able under all circumstances to rock between its two end stable positions. What is more the contact part of the switch element is formed as a tapered tongue that is literally wedged between the two contacts in the closed position so as to ensure a very good contact under all circumstances and, therefore, a continuous electrical circuit.

The float itself according to this invention carries an arm in which is provided the magnet. The entire float, arm, and magnet assembly can be pivotal about a horizontal axis parallel to the rocking axis, with the magnet axis, pivot axis, and rocking axis substantially coplanar in the central metastable position, or can even be vertically slidable within the reservoir by means of appropriate guides.

The system according to the instant invention can be built at very low cost, yet will surely give a warning when the predetermined fluid level has been passed. It can be set up to open the circuit when the fluid passes below a predetermined minimum fluid level or vice versa. Furthermore the single magnet can be replaced by a plurality of magnets. All such modifications are within the scope of this invention.

SPECIFIC DESCRIPTION

Figure 1:
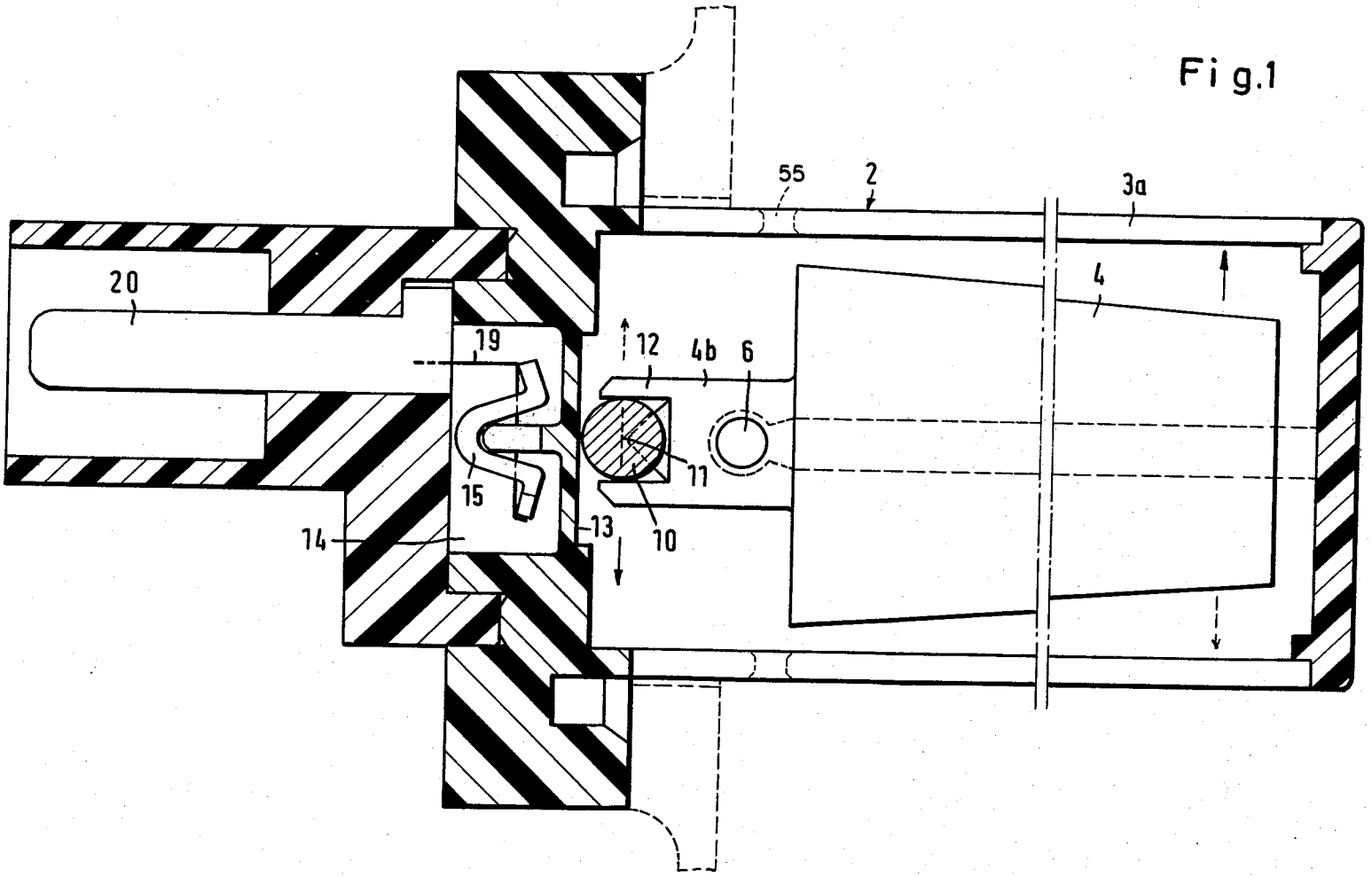
FIG. 1 is a section through the detector according to this invention.
Figure 2:
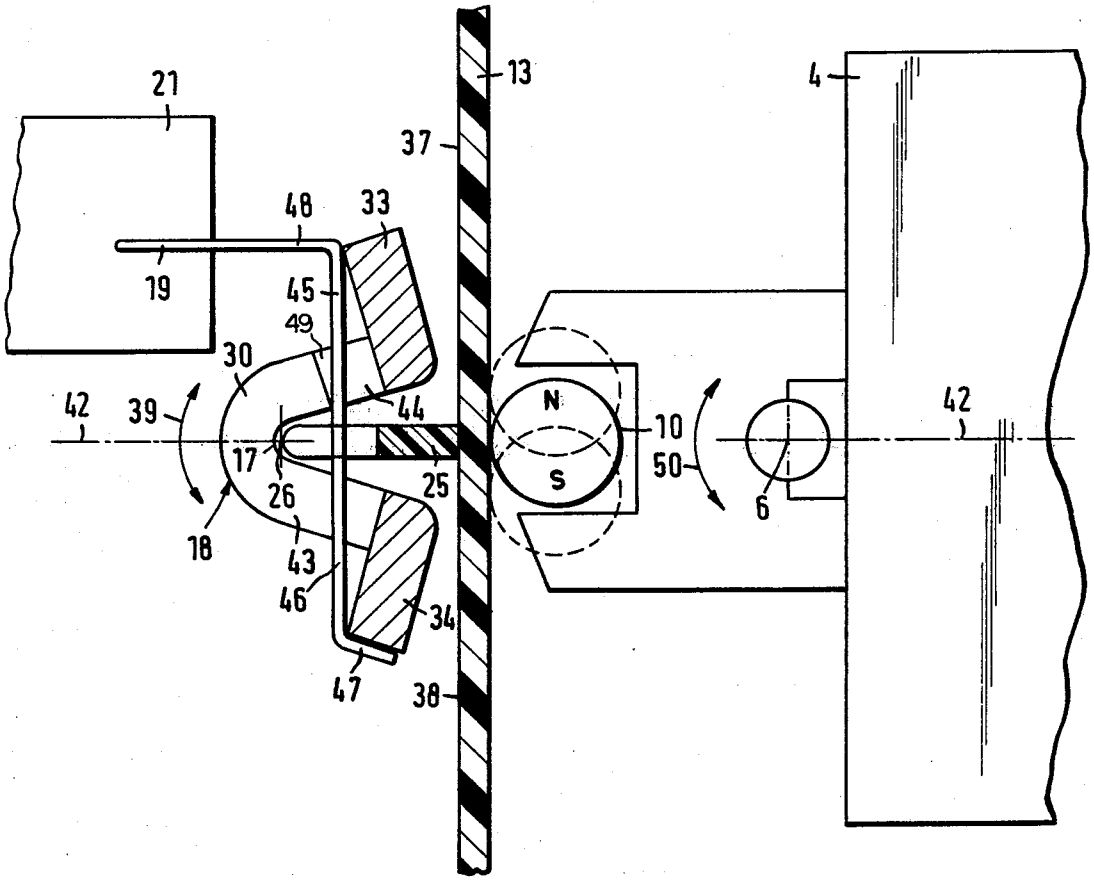
FIG. 2 is a large-scale view of a detail of FIG. 1.
Figure 3:
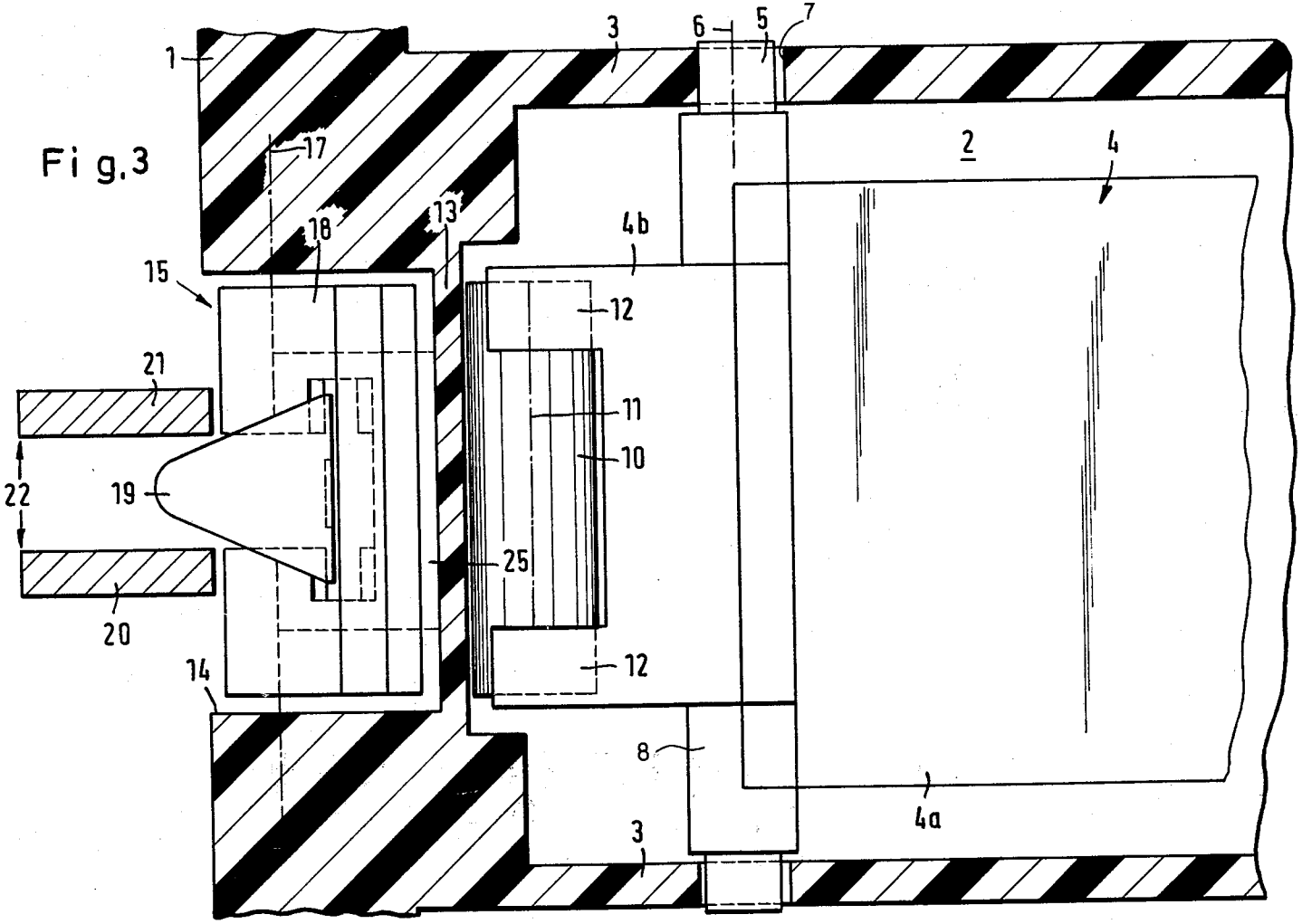
FIG. 3 is a partly sectional top view of the detail shown in FIG. 2.

As shown in FIGS. 1, 2, and 3 a fluid-level detector according to this invention is used in a reservoir 1 provided with a so-called damping chamber 2 having top and bottom walls 3*a* formed with throughgoing holes 55 and side walls 3 formed with aligned throughgoing cylindrical holes 7. Thus it is possible for fluid inside the reservoir 1 to fill the chamber 2, but sloshing of the fluid in the reservoir 1 will not have an immediate effect on the fluid level inside the chamber 2, since fliud can only enter into and exit from this chamber 2 via the relatively small holes 55.

A float 4 has a float part 4*a* formed as a block of closed-cell synthetic-resin foam and an arm 4*b* and is pivotal adjacent the end of the arm 4*b* about an axis 6 defined by a pivot pin 8 formed at its ends with small-diameter cylindrical gudgeons 5 received with play within the holes 7.

One side wall of the compartment 2 is formed as a relatively thin partition 13 of nonmagnetic material, here a synthetic resin, adjacent a recess 14 formed in the wall of the reservoir 1. The arm 4*b* of the float 4 has a pair of forks 12 gripping a cylindrical permanent bar magnet 10 extending along a horizontal axis 11 and polarized transverse to this axis 11. The magnet 10 is received with some play within the forks 12, but is nonetheless constrained for joint pivotal movement about the axis 6 with the arm 4*b* in the directions indicated by arrow 50 of FIG. 2.

The partition 13 is formed with a blade-like projection 25 having an edge 26 defining a pivot axis 17 for an omega-shaped soft-iron switch part 18 having a bight 30 engaged over the edge 26, a pair of legs 43 and 44, and a pair of outwardly directed feet 33 and 34. The switch element 18 also includes a sheet-metal contact part 19 having a main part 45 passing through notches 49 in the leg 44 and having a narrow extension 46 formed with a foot 47 engaged over the end of the foot 34. This contact part 19 also has a tapered tongue-like part 48 engageable between a pair of contacts 20 and 21 separated by a spacing 22 greater than that of the part 48 at its tip but substantially less than it where it joins the section 45.

The feet 33 and 34 have faces extending at an angle of 150° to each other and are flatly engageable with abutment surfaces 37 and 38 of the partition 13.

According to the instant invention the float 4 can rock about the axis 6 as shown by the arrow 50. In the illustrated central position of FIG. 2 the axis 6 of the shaft 8, the axis 11 of the magnet 10, and the rocking axis 17 all lie in a common horizontal plane 42. In this position in theory magnetic forces on the two feet 33 and 34 are equal so they would assume the illustrated metastable position. In fact the arrangement never rests in this position, but only passes through it as the magnet axis 11 passes through the plane 42. When the axis 11 passes above the plane 42, corresponding to a downwardly tipped position of the float part 4*a*, the foot 33 will abut flatly against the surface 37 and will therefore pull the contact part 19 out from between the two contacts 20 and 21 to open a circuit formed thereby. As the magnet axis 11 passes below the plane 42 the foot 34 will be attracted to abut flatly against the surface 38 and the tongue 48 will be wedged between the contacts 20 and 21 to form a closed circuit therebetween.

Figure 1A:
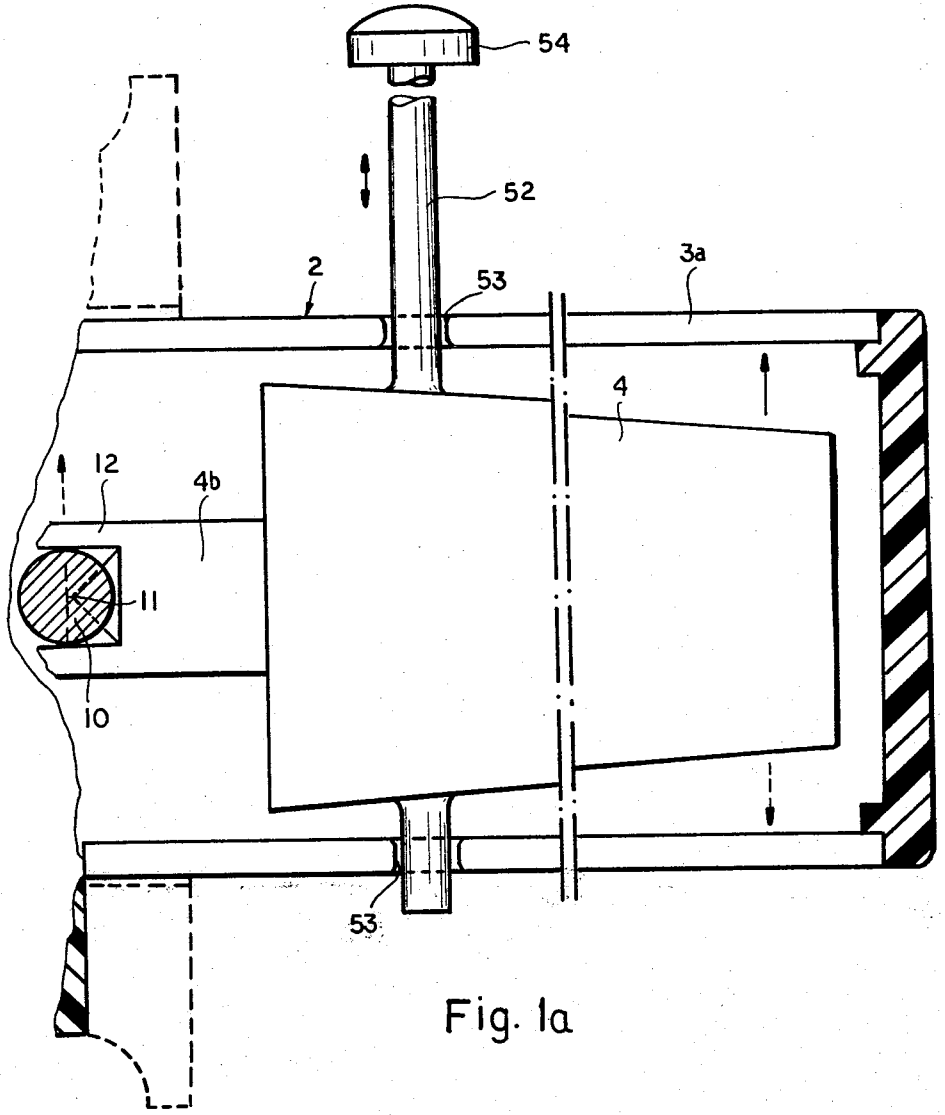
FIG. 1*a* is a partial view of an alternative form of the detector according to this invention.

In the arrangement of FIG. 1*a* the float 4 is not pivotal, but is provided with upwardly and downwardly projecting pins 52 extending with some play through vertically aligned bores 53 in the walls 3*a* of the damping compartment 2. The action will be opposite in this arrangement to that of the arrangement of FIG. 1, that is the circuit between the contacts 20 and 21 will be closed when the float drops below a predetermined level whereas in the arrangement of FIG. 1 the circuit is opened when the float drops below this level. The pins 52 are received with play within the holes 53 which, therefore, allow fluid into and out of the chamber 2. In addition this rod 52 can be provided with an externally operable button 54 so that the user can readily vertically displace this float 4 to determine whether the warning system connected to the contacts 20 and 21 operates.

In the system according to the instant invention the various parts can all fit together with some play, that is the magnet can be received within the forks 12 with play, the gudgeons 5 within the holes 7, and the element 18 can even fit with some play over the blade 25. Thus manufacturing tolerances need not be extremely close. At the same time the device can be counted on to function surely at all times, so that in spite of the ease of manufacture and low cost a detector according to this invention can be used in a high-quality system.

The functioning of the system according to this invention is similar to that of a classic toggle linkage. In this arrangement the magnetic field of the magnet 10 and its effect on the parallel elongated feet 33 and 34 corresponds to the one link of the toggle linkage, so as to create a metastable arrangement wherein, without physical contact, the switch element 18 is moved between a pair of end positions in each of which it is positively held. The advantages of such an arrangement are obvious, as the giving of a false warning, or failure to give a warning when the predetermined level has been passed is eliminated.

I claim:

1. A fluid-level detector comprising:

a container adapted to hold a supply of a fluid and having a side wall having an outer surface forming a pair of vertical spaced abutments;

a float inside said container adapted to float on said fluid;

a permanent bar magnet inside said container, having a longitudinal and horizontal magnet axis generally parallel to said wall, and magnetized transverse to said magnet axis;

link means inside said container connecting said magnet to said float for vertical displacement of said magnet through a predetermined magnet position lying horizontally between said abutments on vertical displacement of said float through a predetermined float position corresponding to a fluid level at which a signal is to be given;

a pair of contacts outside said container;

a switch element outside said container and adjacent said magnet, said element being displaceable by the field of said magnet between a closed position engaging and forming a closed circuit with said contacts and an open position out of engagement with at least one of said contacts, said switch element being generally U-shaped and having a pair of vertically spaced legs, a bight interconnecting said legs and generally horizontally level with said magnet position, and a magnetically attractable and horizontally elongated foot on each of said legs extending generally parallel to said wall and each level with a respective one of said abutments; and means on said container including a pivot on said outer surface and engaging said bight for defining a pair of stable positions for said switch element respectively corresponding to said open and closed positions and for establishing an unstable metastable position between said stable positions and corresponding to said predetermined magnet position, one of said feet being attracted by said magnet and lying flatly against the respective abutment in said open position and the other of said feet being attracted by said magnet and lying flatly against the respective abutment in said closed position, whereby as said magnet passes through said predetermined magnet position said switch element moves between said open and closed positions.

2. The detector defined in claim 1 wherein said pivot defines a rocking axis for said switch element for pivotal movement about said axis between said stable positions.

3. The detector defined in claim 1 wherein said switch element includes a contact part limitedly displaceable on said switch element and engageable with said contacts.

4. The detector defined in claim 3 wherein said switch part has one section engaging said legs and another tapered tongue section engageable wedge fashion in said closed position between said contacts.

5. The detector defined in claim 1 wherein said feet lie at an angle smaller than 180° to each other.

6. The detector defined in claim 1 wherein said link means is an arm pivotal on said container about a horizontal axis parallel to said magnet axis and having one end carrying said float and another end carrying said magnet, said axes being horizontally aligned in said unstable metastable position.

7. The detector defined in claim 1 wherein said container is provided with an internal compartment receiving said float, link means, and magnet and having perforated walls, said compartment limiting the vertical displacement of said float.

8. The detector defined in claim 1 wherein said float is provided with a vertically upwardly and downwardly projecting pin, said container having top and bottom walls receiving the respective pins with play for vertical guiding of said float.

9. The detector defined in claim 8 wherein said link means is a horizontally extending arm on said float holding said magnet.

10. The detector defined in claim 1 wherein said container is a brake-fluid reservoir and said fluid is brake fluid.

11. The detector defined in claim 6 wherein said other end of said arm is formed as a fork loosely receiving said magnet and open toward said wall.

12. The detector defined in claim 1 wherein said means on said container is a blade projecting outwardly from said outer surface between said abutments and having an edge engaging said bight and forming a rocking axis therefor.

* * * * *